US008151896B2

(12) United States Patent
Thompson

(10) Patent No.: US 8,151,896 B2
(45) Date of Patent: Apr. 10, 2012

(54) ONBOARD FIRE SUPPRESSION SYSTEM WITH NOZZLES HAVING PRESSURE-CONFIGURABLE ORIFICES

(75) Inventor: Robert Thompson, Redford, MI (US)

(73) Assignee: Ford Global Technologies, Dearborn, MI (US)

( * ) Notice: Subject to any disclaimer, the term of this patent is extended or adjusted under 35 U.S.C. 154(b) by 1286 days.

(21) Appl. No.: 11/608,959

(22) Filed: Dec. 11, 2006

(65) Prior Publication Data

US 2007/0079974 A1 Apr. 12, 2007

Related U.S. Application Data

(63) Continuation-in-part of application No. 10/907,134, filed on Mar. 22, 2005, now Pat. No. 7,198,111.

(51) Int. Cl.

| | |
|---|---|
| ***A62C 3/07*** | (2006.01) |
| ***A62C 35/02*** | (2006.01) |
| ***A62C 35/00*** | (2006.01) |
| ***A62C 31/05*** | (2006.01) |
| ***A62C 31/02*** | (2006.01) |

(52) U.S. Cl. ..... 169/9; 169/62; 169/74; 239/373; 239/452; 239/DIG. 19

(58) Field of Classification Search ..... 169/9, 16, 169/33, 54, 56, 62, 71, 74, 84, 85; 239/172, 239/175, 176, 373, 451, 452, 456, 533.1, 239/533.13, 546, 602, DIG. 12, DIG. 19
See application file for complete search history.

(56) References Cited

U.S. PATENT DOCUMENTS

| | | | | |
|---|---|---|---|---|
| 3,613,794 | A * | 10/1971 | Naumann et al. | 169/28 |
| 4,132,271 | A | 1/1979 | Mikaila | |
| 5,129,386 | A | 7/1992 | Meister | |
| 5,224,550 | A * | 7/1993 | Bragg | 169/62 |
| 5,590,718 | A | 1/1997 | Bertossi | |
| 5,613,564 | A | 3/1997 | Rhines | |
| 5,762,145 | A | 6/1998 | Bennett | |
| 5,808,541 | A | 9/1998 | Golden | |
| 5,918,681 | A | 7/1999 | Thomas | |
| 5,934,379 | A | 8/1999 | Ostlyngen et al. | |
| 5,960,888 | A | 10/1999 | Moore, Sr. | |
| 5,992,528 | A | 11/1999 | Parkinson et al. | |
| 6,164,383 | A | 12/2000 | Thomas | |
| 6,352,121 | B1 | 3/2002 | Pitell et al. | |
| 6,981,555 | B2 | 1/2006 | Smith et al. | |
| 2004/0084193 | A1 | 5/2004 | Tseng | |
| 2004/0226726 | A1 | 11/2004 | Holland et al. | |

* cited by examiner

*Primary Examiner* — Darren W Gorman
(74) *Attorney, Agent, or Firm* — Jerome R. Drouillard; Frank A. MacKenzie

(57) ABSTRACT

An automotive vehicle includes a vehicle body and at least one reservoir containing a fire suppressant agent. A distribution system receives the fire suppression agent from the reservoir and conducts the agent to at least one location about the vehicle's body in response to the determination by a sensor system and controller that the vehicle has been subjected to a significant impact. The distribution system includes composite nozzles having pressure-configurable orifices.

13 Claims, 9 Drawing Sheets

ONBOARD FIRE SUPPRESSION SYSTEM WITH NOZZLES HAVING PRESSURE-CONFIGURABLE ORIFICES

RELATED APPLICATIONS

The present application is a continuation-in-part of U.S. patent application Ser. No. 10/907,134, filed on Mar. 22, 2005.

BACKGROUND OF THE INVENTION

1. Field of the Invention

The present invention relates to an automotive vehicle having an onboard apparatus for suppressing a vehicle fire.

2. Disclosure Information

Police vehicles are subject to increased exposure to collisions, particularly high-speed rear-end collisions, arising from the need for police officers to stop on the shoulders, or even in the traffic lanes, of busy highways. Unfortunately, other motorists are known to collide with police vehicles employed in this manner. These accidents can compromise the fuel system on any vehicle and may cause fires. The present system is designed to suppress the spread of, or potentially, to extinguish such a fire. U.S. Pat. No. 5,590,718 discloses an anti-fire system for vehicles in which a number of fixed nozzles are furnished with a fire extinguishing agent in response to an impact sensor. The system of the '718 patent suffers from a problem in that the fixed nozzles are not suited to the delivery of the extinguishing agent at ground level. Also, the '718 patent uses a valving system which could become clogged and therefore inoperable. U.S. Pat. No. 5,762,145 discloses a fuel tank fire protection device including a powdered extinguishing agent panel attached to the fuel tank. In general, powder delivery systems are designed to prevent ignition of fires and are deployed upon impact. As a result, the powder may not be able to follow the post-impact movement of the struck vehicle and may not be able to prevent the delayed ignition or re-ignition of a fire.

The present fire suppression system provides significant advantages, as compared with prior art vehicular fire suppression systems.

SUMMARY OF THE INVENTION

According to an aspect of the present invention, an automotive onboard fire suppression system includes at least one reservoir containing a fire suppressant agent and a propellant, operatively associated with the reservoir, for expelling the fire suppressant agent from the reservoir under pressure. A distribution system receives fire suppression agent expelled from the reservoir and distributes the depressant agent in at least one location external to a vehicle. The distribution system includes a number of nozzles having pressure-configurable orifices. These nozzles are normally closed and preferably include generally tubular fiber-reinforced resin conduits having discontinuous fiber reinforcements. These discontinuous reinforcements may include woven, generally tubular fiber preforms with a number of apertures woven into the fiber preform. The apertures are filled with frangible resin prior to deployment of the propellant. The resin is frangible in response to the pressure generated by the propellant.

According to an aspect of the present invention, prior to deployment of the propellant device, the fiber-reinforced resin conduits may be axially and locally retracted by overlapping and wrapping at least one portion of each of the woven reinforcements upon itself, with at least one overlapping portion unwrapping in response to axially directed extension of the woven reinforcement following fracturing of the frangible resin as a result of deployment of the propellant. In the case in which a portion of the tube is overlapped and wrapped upon itself, the apertures may be woven into the reinforcements and be formed by the interstices between the various fibers of the reinforcement. As an alternative, the apertures may be placed mechanically in a woven preform. In either event, the orifices are said to be pressure configurable. As used herein, the term "pressure configurable" means that, in essence, the orifices do not exist prior to deployment of the fire suppression system. When the propellant within the system is activated, frangible resin is either removed forcibly from the apertures by the blow out force provided by the propellant, or in the case of a wrapped woven tube, the blow out force of the propellant will cause the tube to extend axially. This axial extension, combined with the blow out force of the propellant, will cause frangible resin to part from the woven fabric tube, allowing fire suppressant agent to be discharged through interstices formed in the wall of the conduit.

It is an advantage of a system according to the present invention that a lightweight, non-corrosive distribution system may be provided for an onboard fire suppression system.

It is a further advantage of a system according to the present invention that it is not necessary to provide additional sealing of the present distribution system from environmental contamination prior to deployment of the system. This results in a system having lower weight and less cost than known systems.

It is yet another advantage of a system according to the present invention that the system offers superior corrosion resistance, which is particularly beneficial in the context of an automotive underbody.

Other advantages, as well as features of the present invention will become apparent to the reader of this specification.

DETAILED DESCRIPTION OF THE PREFERRED EMBODIMENT

Figure 1:
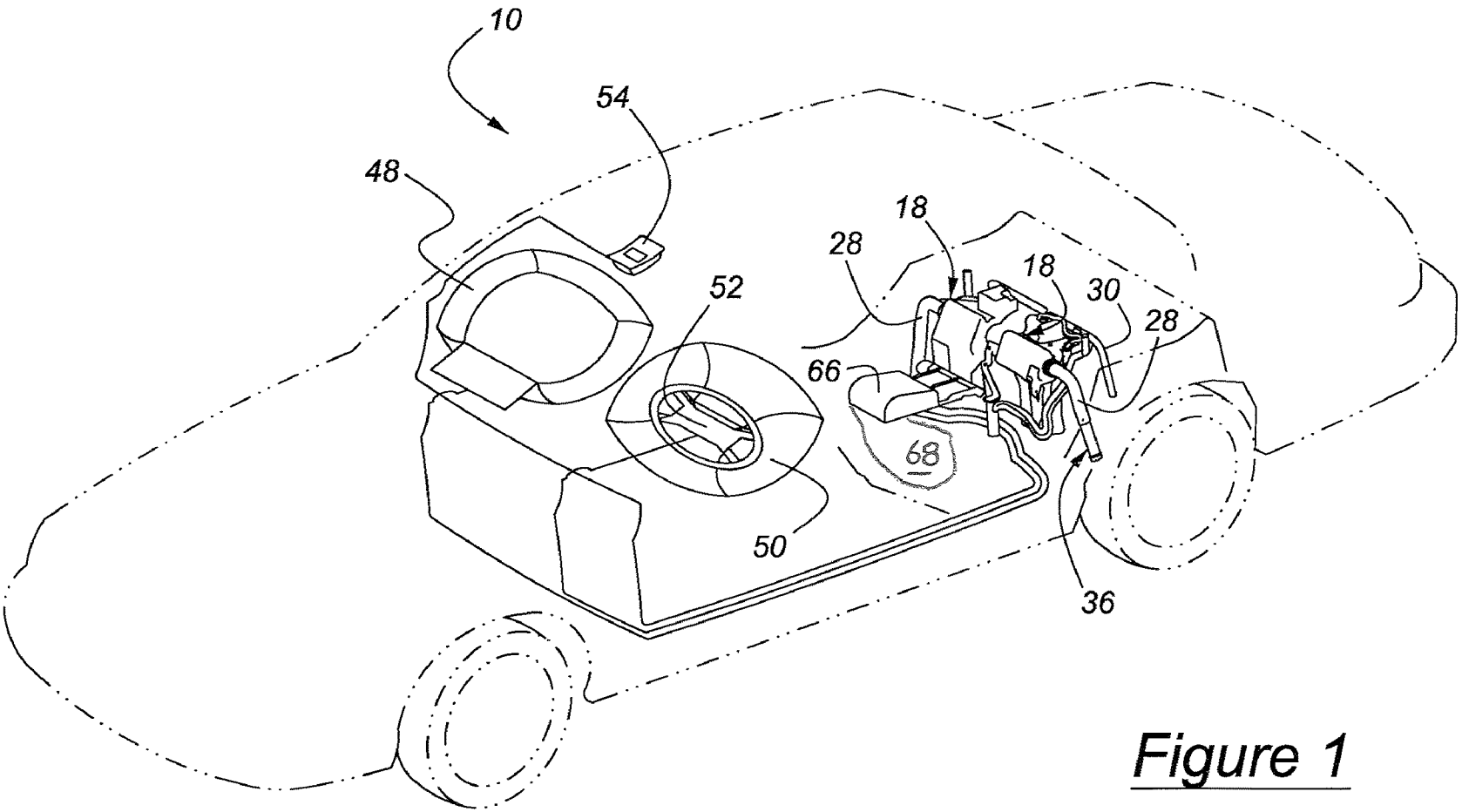
FIG. 1 is a ghost perspective view of an automotive vehicle having a fire suppression system according to the present invention.

As shown in FIG. 1, vehicle 10 has a passenger airbag restraint 48 and a driver's airbag restraint 50 mounted adjacent steering wheel 52. A fire suppression system includes controller 66 which is mounted upon floor pan 68 of vehicle 10, and reservoirs 18 which are mounted under floor pan 68 in the so-called kick-up area adjoining the rear axle of vehicle 10. Those skilled in the art will appreciate in view of this disclosure that additional passenger restraint devices, such as seat belt pretensioners and side airbags, may be installed in a vehicle and controlled at least in part by, or in conjunction with, controller 66.

Figure 2:
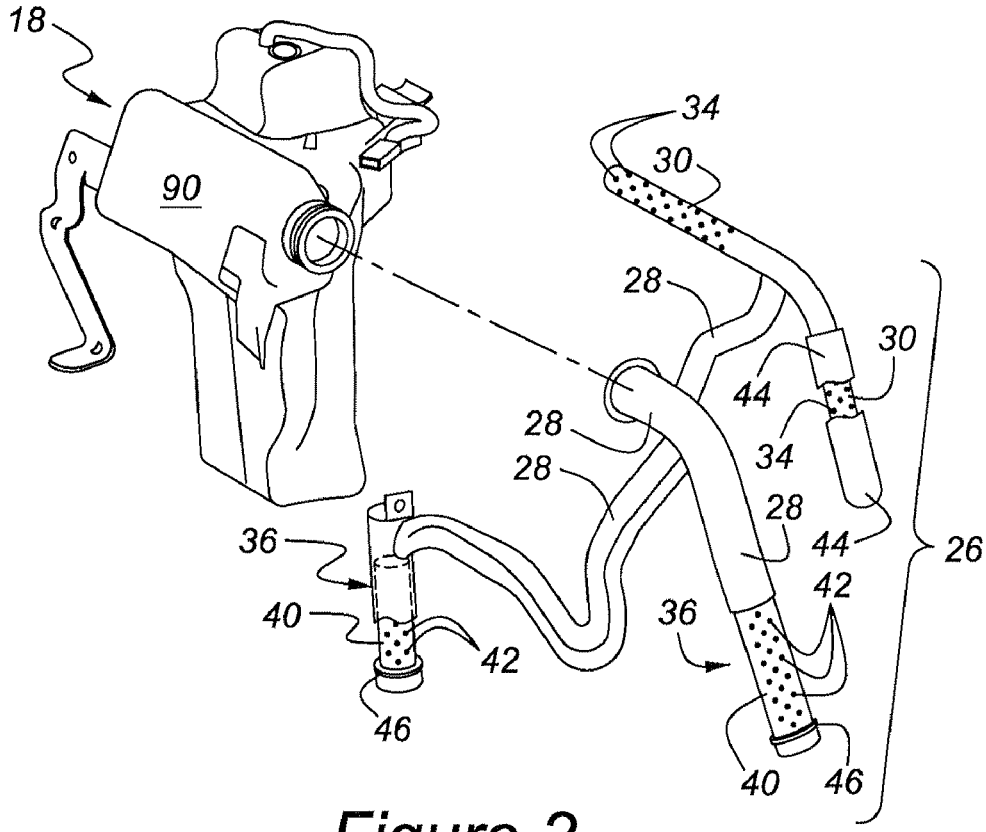
FIG. 2 is an exploded perspective view of a portion of a fire suppression system according to the present invention.
Figure 8:
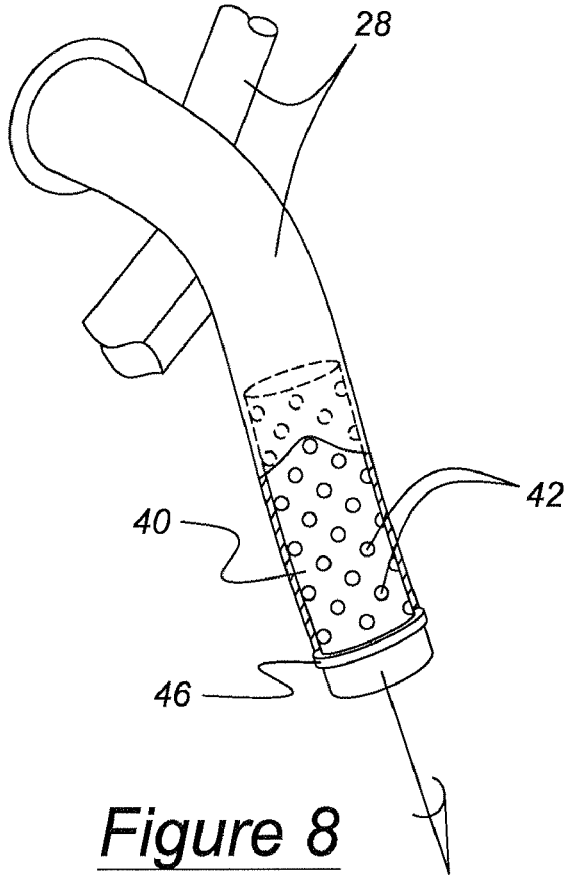
FIG. 8 is a perspective view of a variable geometry fire suppression agent nozzle according to one aspect of the present invention.

FIG. 1 shows not only reservoirs 18 but also a portion of right and left side fire suppression conduits 28, as well as fixed geometry nozzles 30 and variable geometry nozzles 36. As seen in FIG. 1, variable geometry nozzles 36 project downwardly to allow fire suppression agent to be expelled from reservoirs 18 and placed at a low angle to the ground surface the vehicle is operating upon. This mode of operation is possible because variable geometry nozzles 36 are, as shown in FIG. 2, telescopingly extensible. This telescoping feature, which is shown in greater detail in FIG. 8, is produced by a sliding spray head, 40, which is slidingly engaged with conduit 28 such that gas pressure within conduit 28 forces spray head 40 downwardly into its extended position, causing fire suppression agent 22 to be discharged through a number of holes 42 formed in spray head 40. As shown in FIG. 2, at least two variable geometry nozzles 36 may be employed with single reservoir 18, along with at least two fixed nozzles 30 which are spray bars each having a number of orifices 34. While in their normally closed state, variable geometry nozzles 36 are liquid-tight by virtue of seals 46, which are interposed between an end of each of spray heads 40 and the corresponding ends of conduits 28. In a preferred embodiment, seals 46 comprise elastomeric boots attached to an outer surface of conduit 28. Seals 46 are simply sheared by the deploying spray head 40 when the present system is discharged. Fixed nozzles 30 are also rendered liquid-tight by covers 44, which are simply blown off when the present system is discharged. The sealing of nozzles 30 and 36 is important, because this prevents the ingress of road splash, which could block the system in sub-freezing weather or cause corrosion or blockage due to mud or other foreign matter.

Figure 7:
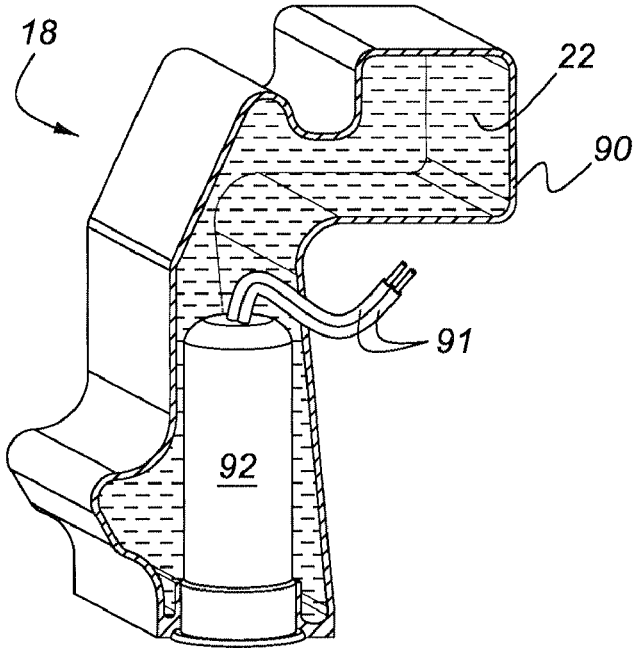
FIG. 7 is a cutaway perspective view of a fire suppression agent reservoir according to one aspect of the present invention.

Additional details of reservoir 18 are shown in FIG. 7. Tank 90 contains approximately 1.5 L of fire suppression agent 22, and a propellant 92. Propellant 92 includes two squibs (not shown) which are activated simultaneously by controller 66 via lines 91 so as to release a large amount of gas, forcing fire suppressant agent 22 from tank 90 and into distribution system 26, including conduit 28 and the various fixed and variable geometry nozzles. A preferred propellant, marketed by Primex Aerospace Company as model FS01-40, is a mixture including aminotetrazole, strontium nitrate, and magnesium carbonate. This is described in U.S. Pat. No. 6,702,033, which is hereby incorporated by reference into this specification.

Those skilled in the art will appreciate in view of this disclosure that other types of propellants could be used in the present system, such as compressed gas canisters and other types of pyrotechnic and chemical devices capable of creating a gas pressure force in a vanishingly small amount of time. Moreover, fire suppressant agent 22, which preferably includes a water-based solution with hydrocarbon surfactants, fluorosurfactants, and organic and inorganic salts sold under the trade name LVS Wet Chemical Agent® by Ansul Incorporated, could comprise other types of agents such as powders or other liquids, or yet other agents known to those skilled in the art and suggested by this disclosure. If two reservoirs 18 are employed with a vehicle, as is shown in FIG. 1, all four squibs will be deployed simultaneously.

Figure 4:
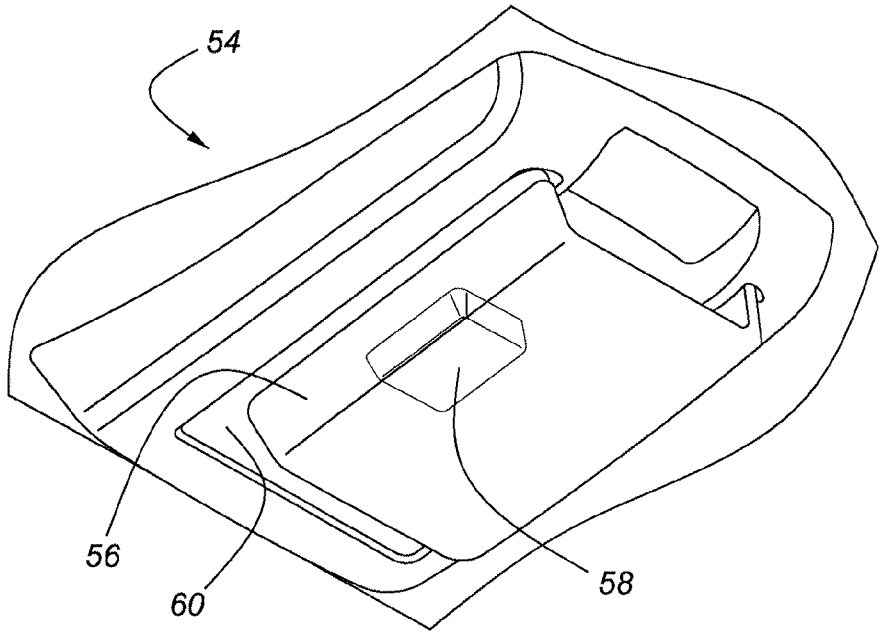
FIG. 4 is a perspective view of a manually activatable switch used with a fire suppression system according to the present invention.

FIG. 4 shows manually activatable switch 54 for use with the present system. As shown in FIG. 1, switch 54 may be advantageously located on the headliner of vehicle 10 between the sun visors, or at any other convenient position. To use this switch 54, hinged clear cover 56 is first opened by pressing on cover 56. Thereafter, the fire suppression system may be triggered by manually pressing pushbutton 58. If the vehicle occupants are not disposed to release cover 56, the system may be triggered by merely sharply depressing cover 56, thereby closing contacts (not shown) contained within platform 60.

Figure 3:
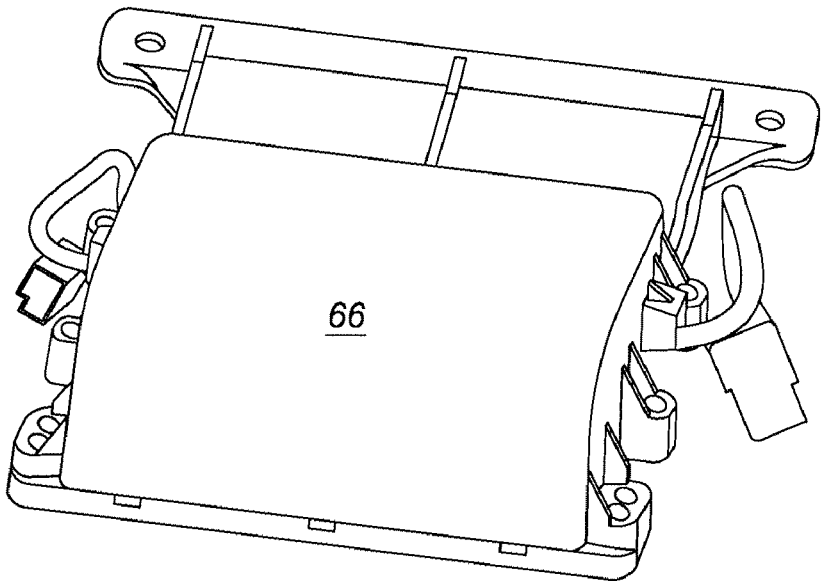
FIG. 3 is a perspective view of a control module used with a system according to the present invention.
Figure 5:
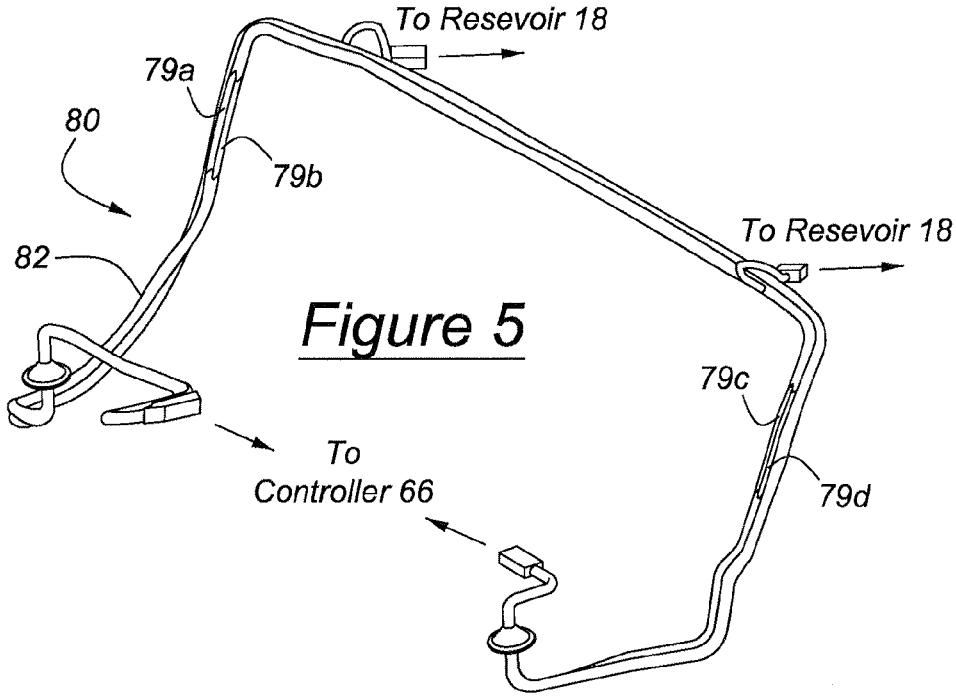
FIG. 5 illustrates a portion of a wiring harness used with the present system.

Because the present system is intended for use when the vehicle has received a severe impact, controller 66, which is shown in FIG. 3, contains a redundant power reserve or supply, which allows operation of the fire suppression system for about nine seconds, even if controller 66 becomes isolated from the vehicle's electrical power supply. Wiring harness 80, as shown in FIG. 5, is armored, and has a para-aramid fiber inner sheath, 82, of about 2 mm in thickness, which helps to shield the conductors within harness 80 from abrasion and cutting during a vehicle impact event. This para-aramid fiber is sold under the trade name KEVLAR® by the DuPont Company. This armoring helps to assure that communication between controller 66 and reservoirs 18 remains in effect during an impact event. Post-impact communications are further aided by redundancy in the control system. Specifically, four independent sets of primary conductors, 79*a-d,* extend from controller 66 to reservoirs 18 protected by sheath 82. Moreover, an H-conductor, shown at 81 in FIG. 5, extends between reservoirs 18. Thus, if one or both of the primary conductors 79*a-b,* or 79*c-d,* extending to one of reservoirs 18 should become severed, H-conductor 81 will be available to carry the initiation signal from the undamaged lines to both of reservoirs 18.

Figure 9:
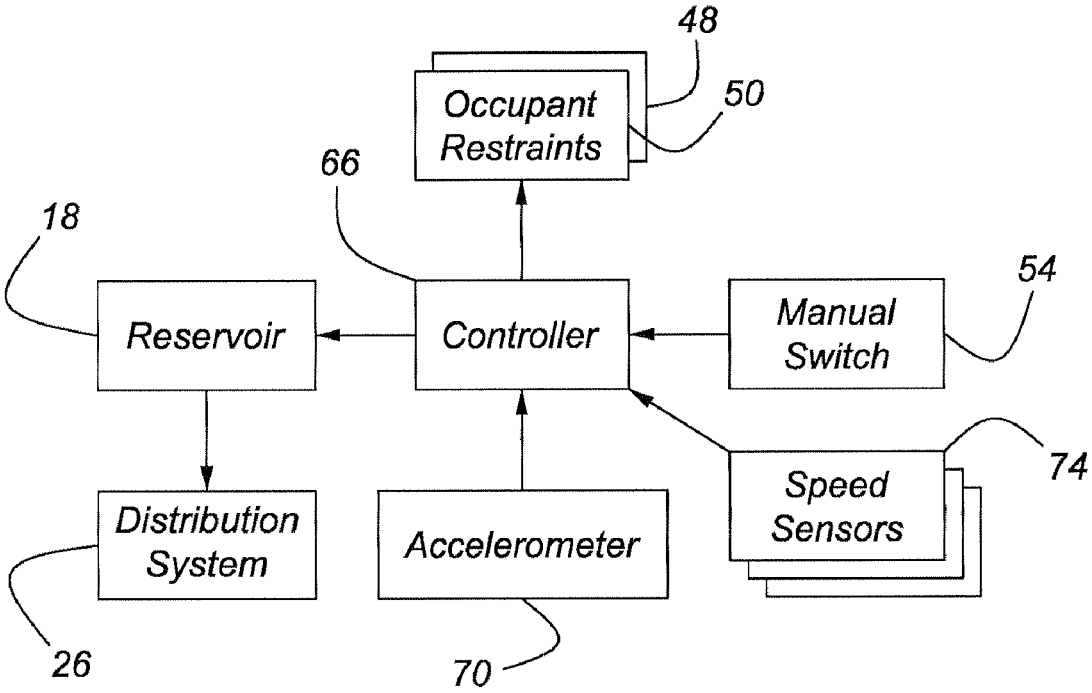
FIG. 9 is a block diagram of a fire suppression system and with additional components for occupant restraint according to one aspect of the present invention.

As noted above, an important feature of the present invention resides in the fact that the control parameters include not only vehicle impact, as measured by an accelerometer such as that shown at 70 in FIG. 9, but also vehicle speed, as measured by means of speed sensors 74, also shown in FIG. 9. Speed sensors 74 may advantageously be existing sensors used with an anti-lock braking system or vehicle stability system. Alternatively, speed sensors 74 could comprise a global positioning sensor or a radar or optically based ground-sensing system. Accelerometer 70, as noted above, could be used with a conventional occupant restraint airbag system, thereby maximizing use of existing systems within the vehicle. Advantageously, accelerometer 70 may be an amalgam of two or more accelerometers having differing sensing ranges. Such arrangements are known to those skilled in the art and suggested by this disclosure. At least a portion of the various sensors could either be integrated in controller 66 or distributed about vehicle 10.

Figure 6:
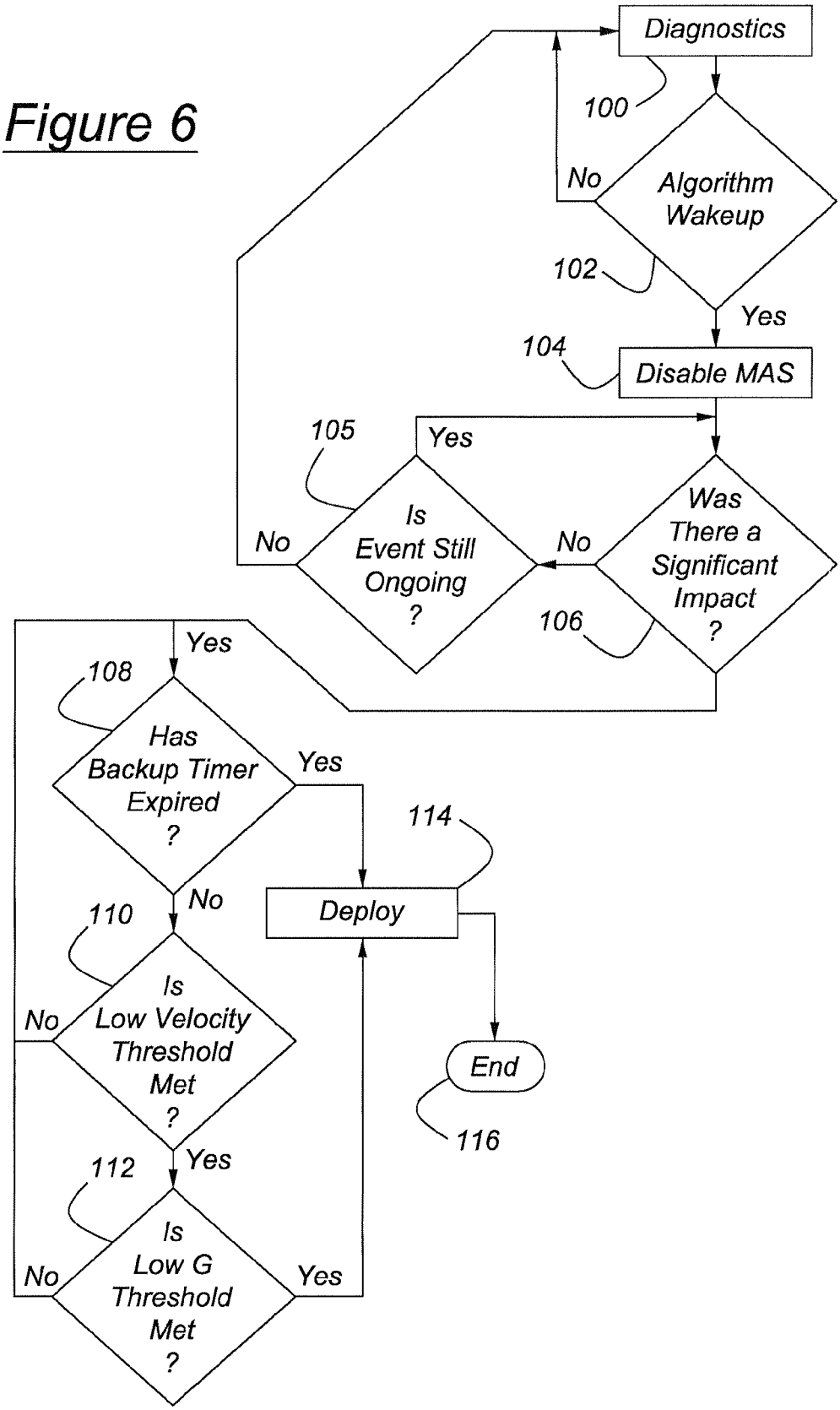
FIG. 6 is a flowchart showing a portion of the logic used to control a system according to the present invention.

FIG. 6 shows a sequence which is used according to one aspect of the present invention for activating a release of fire suppressant agent.

Beginning at block 100, controller 66 performs various diagnostics on the present system, which are similar to the diagnostics currently employed with supplemental restraint systems. For example, various sensor values and system resistances will be evaluated on a continuous basis. Controller 66 periodically moves to block 102, wherein the control algorithm will be shifted from a standby mode to an awake mode in the event that a vehicle acceleration, or, in other words, an impact, having a magnitude in excess of a relatively low threshold is sensed by accelerometer 70. Also, at block 102 a backup timer will be started. If the algorithm is awakened at block 102, controller 66 disables manually activatable switch 54 at block 104 for a predetermined amount of time, say 150 milliseconds. This serves to prevent switch 54 from inadvertently causing an out-of-sequence release of fire suppression agent. Note that at block 104, a decision has not yet been made to deploy fire suppression agent 22 as a result of a significant impact.

At block 106, controller 66 uses output from accelerometer 70 to determine whether there has been an impact upon vehicle 10 having a severity in excess of a predetermined threshold impact value. Such an impact may be termed a significant, or "trigger", impact. If an impact is less severe than a trigger impact, the answer at block 106 is "no", and controller 66 will move to block 105, wherein an inquiry is made regarding the continuing nature of the impact event. If the event has ended, the routine moves to block 100 and continues with the diagnostics. If the event is proceeding, the answer at block 105 is "yes", and the routine loops to block 106.

If a significant impact is sensed by the sensor system including accelerometer 70 and controller 66, the answer at block 106 will be "yes." If such is the case, controller 66 moves to block 108 wherein the status of a backup timer is checked. This timer was started at block 102.

Once the timer within controller 66 has counted up to a predetermined, calibratable time on the order of, for example, 5-6 seconds, controller 66 will cause propellant 92 to initiate delivery of fire suppressant agent 22, provided the agent was not released earlier. Propellant 92 is activated by firing an electrical squib so as to initiate combustion of a pyrotechnic charge. Alternatively, a squib may be used to pierce, or otherwise breach, a pressure vessel. Those skilled in the art will appreciate in view of this disclosure that several additional means are available for generating the gas required to expel fire suppressant agent 22 from tank 90. Such detail is beyond the scope of this invention. An important redundancy is supplied by having two squibs located within each of tanks 90. All four squibs are energized simultaneously.

The velocity of the vehicle 10 is measured at block 110 using speed sensors 74, and compared with a low velocity threshold. In essence, controller 66 processes the signals from the various wheel speed sensors 74 by entering the greatest absolute value of the several wheel speeds into a register. This register contains both a weighted count of the number of samples below a threshold and a count of the number of samples above the threshold. When the register value crosses a threshold value, the answer at block 110 becomes "yes." In general, the present inventors have determined that it is desirable to deploy fire suppression agent 22 prior to the vehicle coming to a stop. For example, fire suppression agent 22 could be dispersed when the vehicle slows below about 15 kph.

At block 112, controller 66 enters a measured vehicle acceleration value into a second register. Thereafter, once the acceleration register value decays below a predetermined low g threshold, the answer becomes "yes" at block 112, and the routine moves to block 114 and releases fire suppressant agent 22. In essence, a sensor fusion method combines all available sensor information to verify that the vehicle is approaching a halt. The routine ends at block 116. Because the present fire suppression system uses all of the available fire suppression agent 22 in a single deployment, the system cannot be redeployed without replacing at least reservoirs 18.

FIG. 6 does not include the activation of occupant restraints 48 and 50, it being understood that known control sequences, having much different timing constraints, may be employed for this purpose. In point of contrast, the low velocity threshold allows the present system to deliver the fire suppression agent while the vehicle is still moving, albeit at a very low velocity. This prevents the rear wheels of the vehicle from shadowing, or blocking dispersion of fire suppressant agent 22. Also, in many cases, a vehicular fire may not become well-established until the vehicle comes to a halt.

Figure 10:
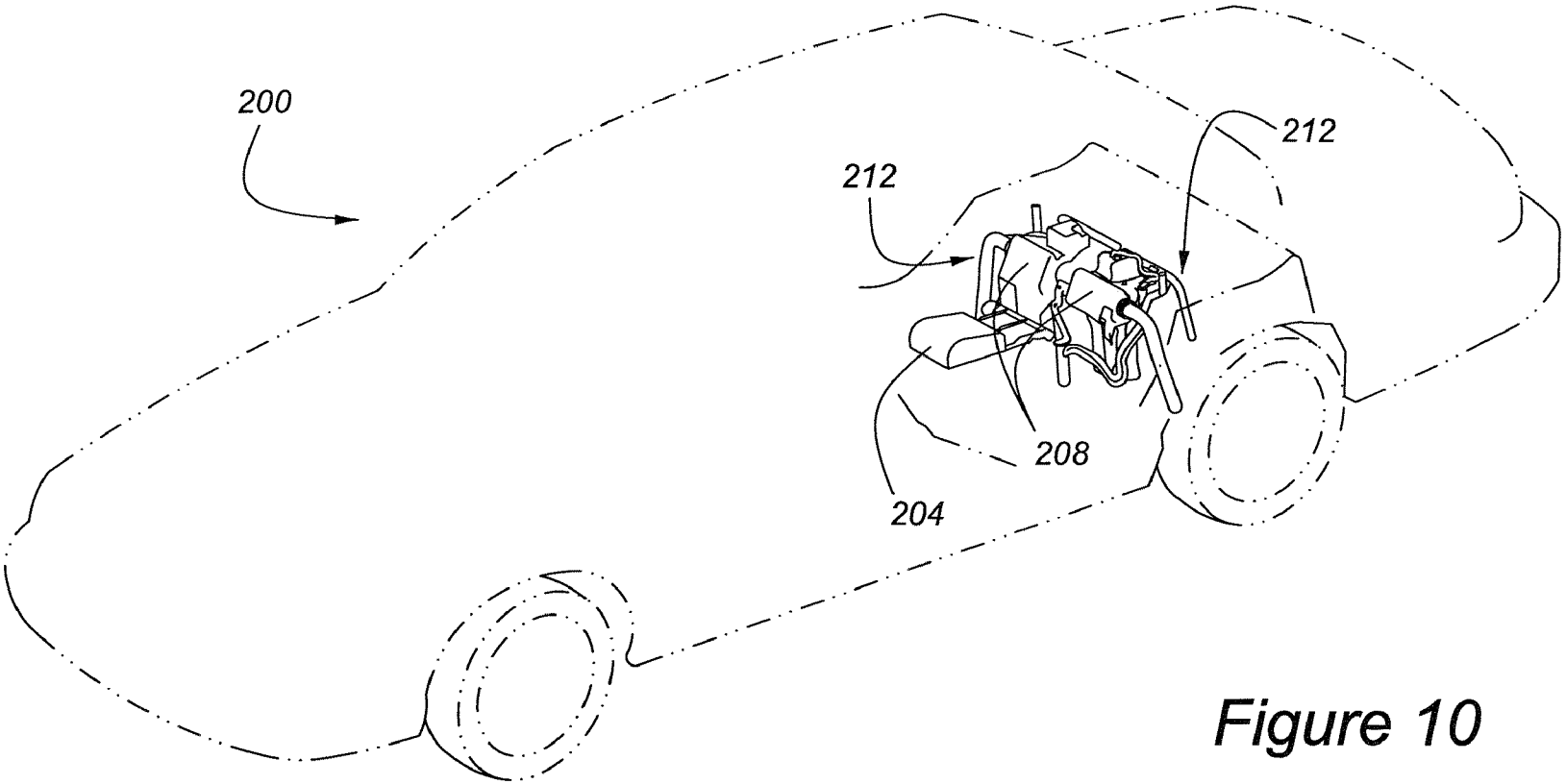
FIG. 10 is a perspective view of a vehicle having a fire suppression system with pressure-configurable nozzles according to one aspect of the present invention.

As shown in FIG. 10, vehicle 200 has controller 204 for operating the present onboard fire suppression system by discharging fire suppressant through reservoirs 208, which are connected with distribution system 212. As is further shown in FIG. 11, distribution system 212 includes nozzles 216 having orifices 232 and 244. Distribution system 212 may either be combined, such that suppressant agent is received from both of reservoirs 208, or separated, such that each of reservoirs 208 supplies suppressant agent to a different distribution system.

Figure 11:
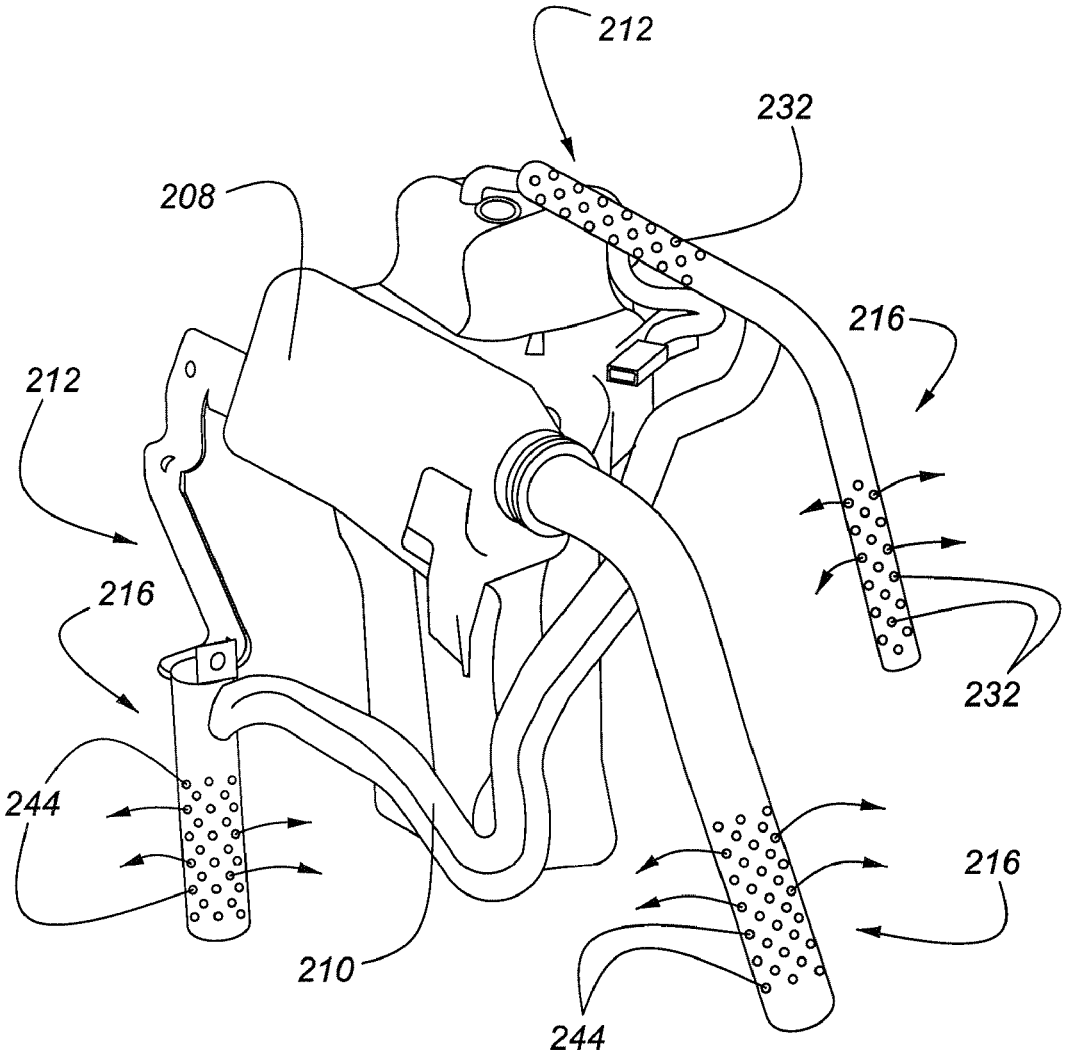
FIG. 11 is a perspective view of a suppression agent reservoir and distribution system according to one aspect of the present invention.
Figure 12:
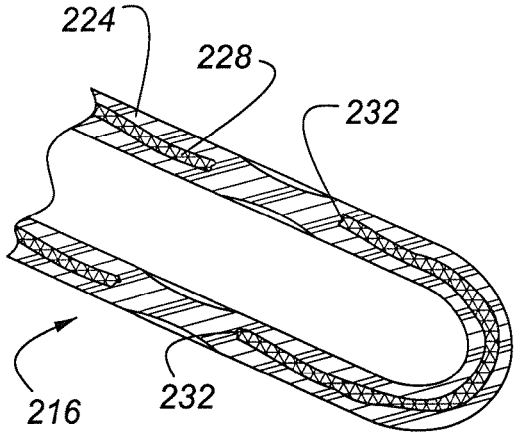
FIG. 12 is a sectional view of a first embodiment of a nozzle portion of the distribution system of FIG. 11, prior to deployment of the fire suppression system.
Figure 13:
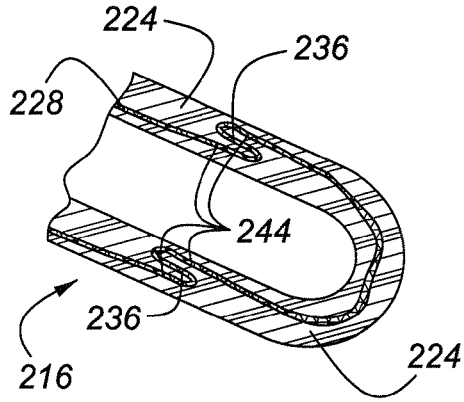
FIG. 13 is a sectional view of a second embodiment of a nozzle portion of the distribution system of FIG. 11, prior to deployment of the fire suppression system.
Figure 14:
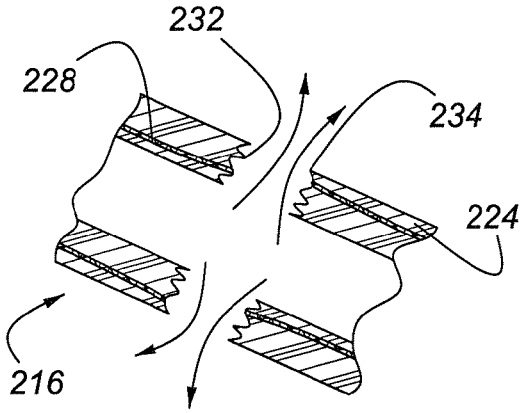
FIG. 14 illustrates the nozzle portion of FIG. 12 during deployment of the fire suppression system.

FIGS. 12-15 show the construction and operation of the present normally closed, pressure configurable orifices within nozzles 216. Beginning with FIG. 12, woven generally tubular fiber preform 228 functions as a reinforcement for resin 224. Tubular fiber-reinforcement 228 has a number of apertures, 232, which are pre-existing. Note that apertures 232 result in a discontinuity within fiber reinforcement 228. Because resin 224 is frangible, the pressure produced by a propellant, such as propellant 92, will cause resin 224 to fracture, thereby forming orifices extending through the walls of nozzles 216. These fracture orifices, 234, are shown in FIG. 14. In essence, apertures 232, when stripped of resin 224, become orifices 234. According to another aspect of the present invention, a metallic header, 210 may be combined with a fiber reinforced resin nozzle as part of distribution system 212 (FIG. 11).

Figure 15:
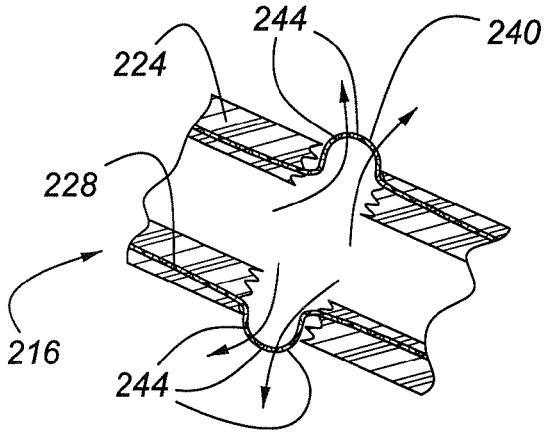
FIG. 15 illustrates the nozzle portion of FIG. 13 during deployment of the fire suppression system.

The mechanism associated with the formation of orifices in the embodiment shown in FIGS. 13 and 15 is different from that of FIGS. 12 and 14. In the embodiment first shown in FIG. 13, tubular fiber-reinforcement 228 is overlapped and wrapped upon itself at section 236. Note that as wrapped, section 236 contains a number of integral orifices 244. These orifices are not available for use until resin 224 has fractured as shown in FIG. 15. Upon the fracturing of resin 224, expanded sections 240 are produced, and these sections contain a number of integral orifices 244, which allow discharge of suppression agent through orifices 244. The presence of overlapped and wrapped sections 236 allow nozzles 216, as shown in FIGS. 13 and 15, to move from an axially and locally retracted position to an axially expanded or lengthened position following the activation of the propellant. This permits the geometry of nozzles 216, when equipped with multiple overlapped and wrapped sections, to approach ground level without the need for mechanically telescoping nozzle devices, or for that matter, without the need for any external seals.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. An onboard fire suppression system, comprising:

at least one reservoir containing a fire suppressant agent;

a propellant, operatively associated with said reservoir, for expelling the fire suppressant agent from the reservoir under pressure; and a distribution system for receiving fire suppressant agent expelled from said reservoir and for distributing the suppressant agent in at least one location external to a vehicle, with said distribution system comprising a plurality of nozzles having pressure-configurable orifices.

2. An onboard fire suppression system according to claim 1, wherein said pressure-configurable nozzles are normally closed.

3. An onboard fire suppression system according to claim 1, wherein said nozzles comprise generally tubular, fiber-reinforced resin conduits having discontinuous fiber reinforcements.

4. An onboard fire suppression system according to claim 3, wherein at least one of said discontinuous reinforcements comprises a woven, generally tubular fiber preform having a plurality of apertures.

5. An onboard fire suppression system according to claim 4, wherein said plurality of apertures is filled with resin prior to deployment of said propellant.

6. An onboard fire suppression system according to claim 5, wherein said resin is frangible in response to the pressure generated by said propellant.

7. An onboard fire suppression system according to claim 1, wherein said nozzles comprise generally tubular, fiber-reinforced, frangible resin conduits having generally tubular, woven reinforcements.

8. An onboard fire suppression system according to claim 7, wherein said generally tubular, fiber-reinforced, frangible resin conduits are axially and locally retracted prior to deployment of said propellant.

9. An onboard fire suppression system according to claim 8, wherein said woven reinforcements are axially and locally retracted by overlapping and wrapping at least one portion of each of said woven reinforcements upon itself, with said at least one overlapping portion unwrapping in response to axially directed extension of said woven reinforcement following fracturing of said frangible resin as a result of deployment of said propellant.

10. An onboard fire suppression system, comprising:

at least one reservoir containing a fire suppressant agent;

a propellant, operatively associated with said reservoir, for expelling the fire suppressant agent from the reservoir under pressure; and a distribution system for receiving fire suppressant agent expelled from said reservoir and for distributing the suppressant agent in at least one location external to a vehicle, with said distribution system comprising a plurality of normally closed, fiber-reinforced frangible resin nozzles having pressure-configurable orifices defined by discontinuities in said fiber reinforcements, with said discontinuities causing said resin to be locally frangible in response to pressure developed by said propellant.

11. An onboard fire suppression system according to claim 10, wherein said nozzles comprise generally tubular, fiber-reinforced resin conduits.

12. An onboard fire suppression system according to claim 10, wherein said reinforcements comprise woven, generally tubular fiber preforms having a plurality of apertures which are filled with resin prior to deployment of said propellant.

13. An onboard fire suppression system according to claim 10, wherein said reinforcements comprise woven tubes which are axially and locally retracted by overlapping and wrapping at least one portion of each of said woven reinforcements upon itself, with said at least one overlapping portion unwrapping in response to axially directed extension of said woven reinforcement following fracturing of said frangible resin as a result of deployment of said propellant.

* * * * *